US005388559A

United States Patent [19]

O'Keefe

[11] Patent Number: 5,388,559

[45] Date of Patent: Feb. 14, 1995

[54] INDUCTION REGULATOR FOR AN INTERNAL COMBUSTION ENGINE

[75] Inventor: Michael O'Keefe, Liverpool, England

[73] Assignee: Phoenix Marketing and Engineering, Ltd., Newport, United Kingdom

[21] Appl. No.: 126,389

[22] Filed: Sep. 24, 1993

[30] Foreign Application Priority Data

Sep. 24, 1992 [GB] United Kingdom ..... 9220188

[51] Int. Cl.[6] ..... F02M 29/04

[52] U.S. Cl. ..... 123/593; 48/189.6

[58] Field of Search ..... 123/590, 593; 48/189.6

[56] References Cited

U.S. PATENT DOCUMENTS

| | | | |
|---|---|---|---|
| 3,841,284 | 10/1974 | Krygowski . | |
| 4,015,575 | 4/1977 | Fox | 123/593 |
| 4,088,104 | 5/1978 | Ibbott | 123/593 |
| 4,091,786 | 5/1978 | Hartopp | 123/593 |
| 4,295,458 | 10/1981 | Pellerin | 123/593 |
| 4,359,035 | 11/1982 | Johnson | 123/593 |
| 4,361,128 | 11/1982 | Goldman | 123/593 |
| 4,452,219 | 6/1984 | Tay-Lodge et al. . | |
| 4,478,607 | 10/1984 | Capps | 123/593 |
| 4,974,573 | 12/1990 | Jensen | 123/593 |

FOREIGN PATENT DOCUMENTS

| | | |
|---|---|---|
| 359636 | 10/1931 | United Kingdom . |
| 2099074 | 12/1982 | United Kingdom . |

*Primary Examiner*—E. Rollins Cross
*Assistant Examiner*—Erick Solis
*Attorney, Agent, or Firm*—Rothwell, Figg, Ernst & Kurz

[57] ABSTRACT

An induction regulator for an internal combustion engine comprises at least one perforated element for allowing passage of fuel/air mixture therethrough, at least one open top reservoir for retaining excess unvaporized fuel and a closed loop supporting strip which is coupled to the perforated element. The closed loop is mounted between opposed flanges of the engine manifold which is downstream of the engine's carburetor. The regulator improves the atomization of the fuel as it is processed through the manifold and carburetor, thereby leading to improved fuel consumption and reduced exhaust pollution. The continuous closed loop supporting strip provides for secure attachment of the regulator to the manifold, as well as allows for easier adjustment of the regulator with respect to the manifold.

10 Claims, 3 Drawing Sheets

INDUCTION REGULATOR FOR AN INTERNAL COMBUSTION ENGINE

BACKGROUND

1. Field of the Invention

The present invention relates to an induction regulator for an internal combustion engine.

2. Related Prior Art

An induction regulator is known from UK Patent Number 2099074. The regulator is designed to compensate for irregularities in the supply to and demand for fuel from the engine, and thus leads to improved fuel consumption, reduced exhaust pollution, and better fuel atomization/vaporization. For this purpose this known regulator is adapted to be disposed in the inlet manifold of the engine, downstream of the carburetor and comprises a perforated element allowing the passage of a fuel and air mixture therethrough, an open topped reservoir for retaining excess unvaporized fuel and a pair of mounting straps depending from the perforated element for fixing the regulator within the manifold. The ends of the straps may be bent outwardly at right-angles in order to permit them to be clamped between the inlet manifold and the carburetor. The perforated element is disposed at an angle to the straps such that when the regulator is installed the perforated element is disposed at a defined angle to the manifold wall in order to optimize atomization.

One of the drawbacks of this known regulator is the mounting straps. Because these straps are bent by the person installing the regulator within the manifold, it is very easy to bend the straps with respect to the perforated element such that the perforated element would not then be disposed at the required angle to the manifold. Furthermore by bending the straps in this way, the straps can be weakened and strain can result at the point where the end of each strap is clamped between the carburetor and the inlet manifold. With time the straps could snap and the regulator could fall into the internal combustion engine, resulting in considerable damage to the engine. It thus is the aim of the present invention to provide an induction regulator for an internal combustion engine which overcomes or alleviates the problems associated with the known induction regulators.

SUMMARY OF THE INVENTION

In accordance with the present invention, there is provided an induction regulator for an internal combustion engine having a carburetor and a manifold downstream thereof, the regulator comprising at least one perforated element for allowing passage of fuel and air mixture therethrough, at least one open top reservoir for retaining excess unvaporized fuel and a closed loop supporting strip coupled to the at least one perforated element wherein the closed loop supporting strip is mountable between opposed flanges of the engine manifold.

With this arrangement of the regulator the continuous strip could be clamped between, for instance, the outlet of the carburetor and the inlet of the inlet manifold and hence form a more secure fixing for the regulator by spreading the clamping force over a wider area. Furthermore, there is no need to bend the strip to fit the required use and hence bend the perforated element from its required angle in relation to its mounting within the inlet manifold. The size and shape of the continuous strip can be of various sizes in order to suit its required environment.

In a preferred embodiment, the regulator comprises two perforated elements each having a dependent open top reservoir and a common continuous strip.

With this arrangement, a regulator can be placed downstream of each choke of say a twin choke carburetor which feeds into a single inlet manifold. Preferably, a pair of metallic strips extend from the or each perforated element and the ends of the strip remote from the or each perforated element are secured to the continuous strip.

With this arrangement of the regulator, the or each perforated element can be more easily angled with respect to its pair of strips.

Preferably, the or each perforated element comprises a metal gauze bounded by a frame whose shape corresponds with that of the inlet manifold into which the regulator is to be fitted. Preferably the gauze is planar and disposed at an angle to the manifold wall. The angle may be in the range of 13° to 25° but is preferably 18° when the regulator is positioned at a bend in the manifold for example where the inlet gases change direction between moving vertically and moving horizontally as is the case with a down draught carburetor.

Preferably, the pair of strips for the or each regulator extend from the frame bounding the gauze.

The or each open top reservoir comprises a rectangular tank which is secured to or forms part of the frame and the open top is positioned adjacent the gauze on the downstream side thereof. The tank preferably extends across the width of the gauze in a central position leaving unrestricted passage through the gauze both above and below its longitudinal edges. The arrangement is such that unvaporized fuel collects in the tank and when the engine requires extra fuel it vaporizes from this tank passing initially upstream through the gauze covering the open top of the tank and then downstream through the gauze positioned on either side of the tank. The gauze serves to improve atomization of the fuel and air mixture and by virtue of the turbulence created generates a swirling action in the inlet manifold which leads to improved combustion.

DESCRIPTION OF THE PREFERRED EMBODIMENT OF THE INVENTION

By way of example only, specific embodiments of the present invention will now be described, with reference to the accompanying drawings.

Figure 1:
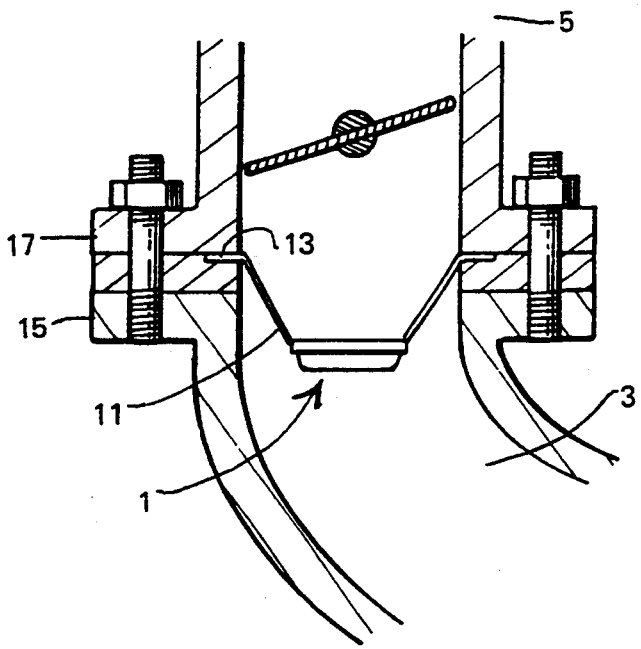
FIG. 1 is a schematic view illustrating a regulator constructed in accordance with a first aspect of the present invention and located in a manifold.
Figure 2:
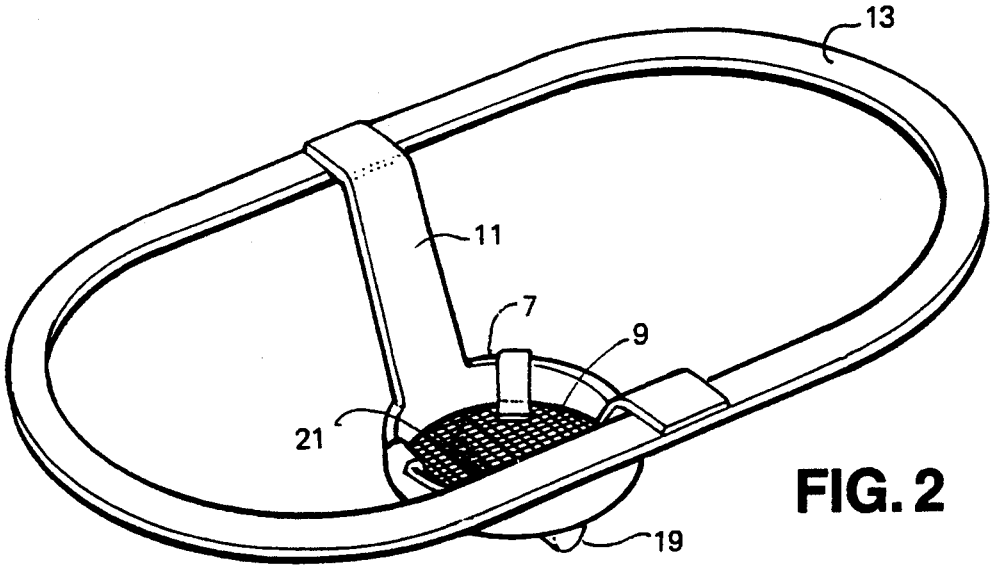
FIG. 2 is a perspective view of the regulator illustrated in FIG. 1.
Figure 3:
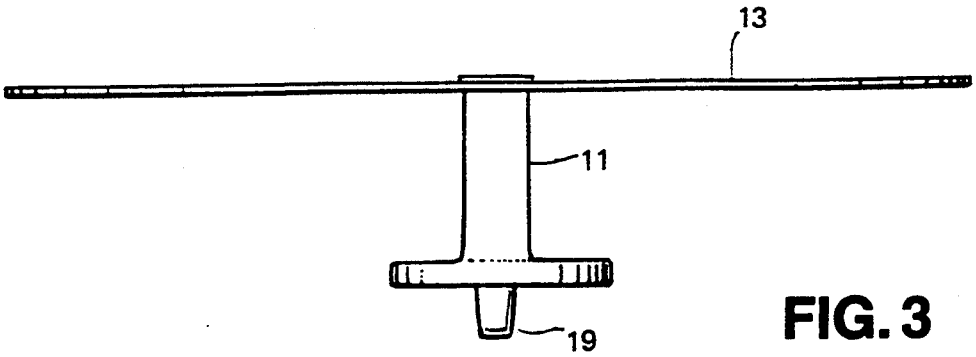
FIG. 3 is a side view of the regulator illustrated in FIGS. 1 and 2.

In FIG. 1, an induction regulator 1 is shown disposed in an induction manifold 3, downstream of a carburetor 5. As best illustrated in FIGS. 2 and 3, the regulator comprises a frame 7 which bounds a metallic gauze 9 and which acts to support the gauze 9 around its periphery. Two strips of metal 11 extend from the frame 7. The strips 11 are secured at their ends remote from the frame 7 to a continuous strip of metal 13. The continuous strip can be clamped between a flange 15 of the inlet manifold 3 and a flange 17 of the carburetor 5 as illustrated in FIG. 1. A gasket or the like (not illustrated) can be clamped between the continuous strip 11 and the flange 17. The frame 7 is disposed at an angle to the strips 11 and preferably at an angle of 72°.

An open top reservoir 19 is secured to the frame and its edges surrounding the open top are formed with a lip 21 which serves to support the gauze 9. The reservoir 19 is elongate and is positioned centrally across the width of the gauze 9, between the points where the strips 11 connect to the frame 7. The gauze 9 extends over the open top of the reservoir 19. The reservoir serves as a drip tank to catch and retain any unvaporized petrol in the induction gases.

The regulator assembly is made of copper which is a good conductor of heat so that fuel vaporization is aided and/or accelerated. The size of the gauze is dependent upon the size of the inlet manifold to which the regulator is to be fitted and the mesh size of the gauze is likewise varied to optimize the air flow requirements through the regulator. The capacity of the reservoir may be varied to suit the induction requirements of different capacity of engines. The size and shape of the continuous strip 13 is dependent on the size and shape of the inlet manifold to which the regulator is to be fitted and is suitable for clamping between the carburetor and the inlet manifold.

Figure 4:
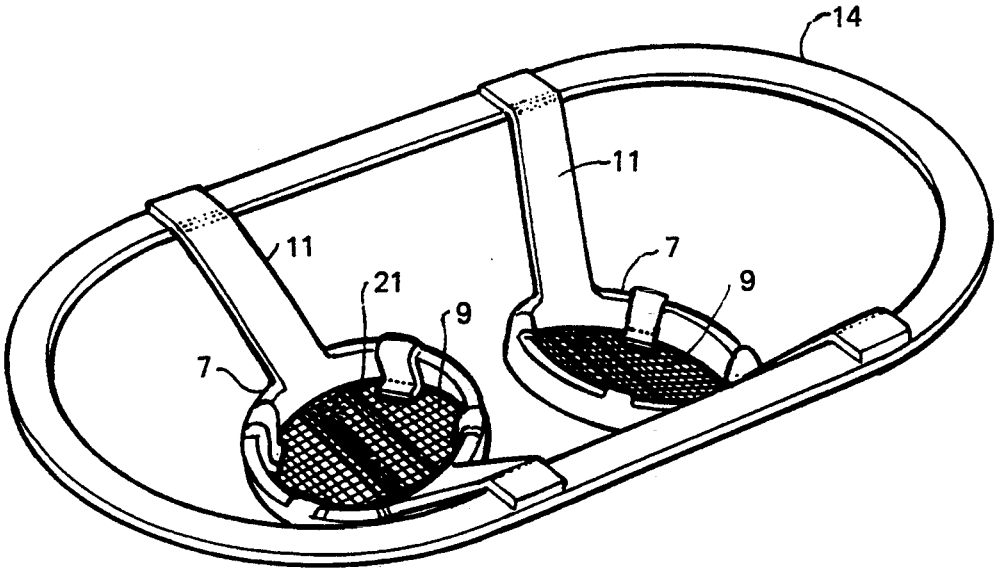
FIG. 4 is a perspective view of a regulator constructed in accordance with a second embodiment of the present invention.
Figure 5:
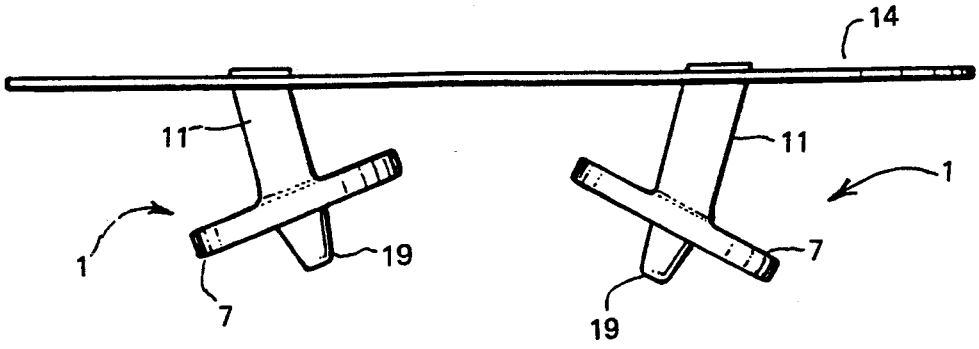
FIG. 5 is a side view of the regulator illustrated in FIG. 4.

FIGS. 4 and 5 illustrate an arrangement of the invention suitable for high performance vehicles having a twin-choke carburetor leading into a single inlet manifold. In this embodiment, a pair of induction regulator, one associated with each choke, is provided, and the induction regulators share a common continuous strip 14. As with the embodiment described earlier, the strip 14 is of a shape and size suitable for clamping between the junction of the inlet manifold and the twin-choke carburetor. Each of the induction regulators is angled with respect to its associated choke so as to optimize the airflow requirements therethrough, as described above.

For a high performance vehicle having a carburetor with more than two chokes, a number of regulators 1, corresponding to the number of chokes, can be provided on the continuous strip and can be appropriately angled.

While the embodiment of FIGS. 1 to 5 has been described with respect to a perforated element employing a gauze, the gauze may in certain circumstances be replaced by a metallic plate which has a plurality of through holes. In this way the required number of holes may be formed in plate to suit the induction requirements.

In the preferred construction the gauze or perforated plate is disposed at an angle of 18° to the axis of the manifold on the downstream side of the regulator. In alternative constructions the angle may vary within the range of 13° to 25°.

Figure 6:
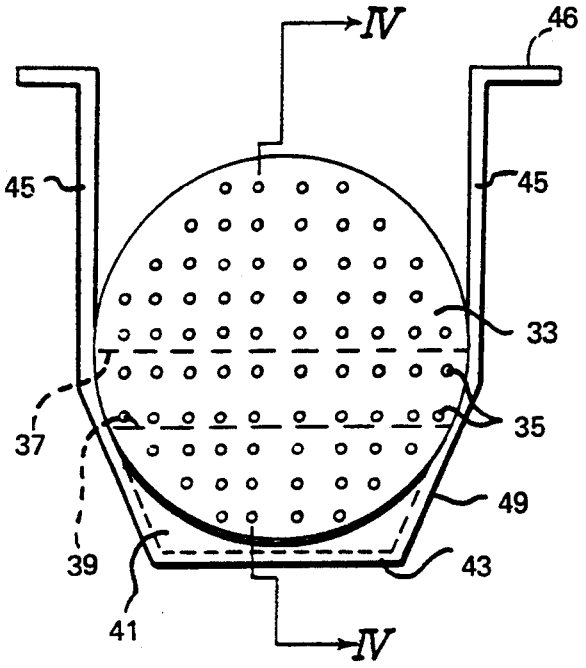
FIG. 6 is a front view of an alternative embodiment of the perforated element and reservoir for the regulator illustrated in FIGS. 2 and 4.
Figure 7:
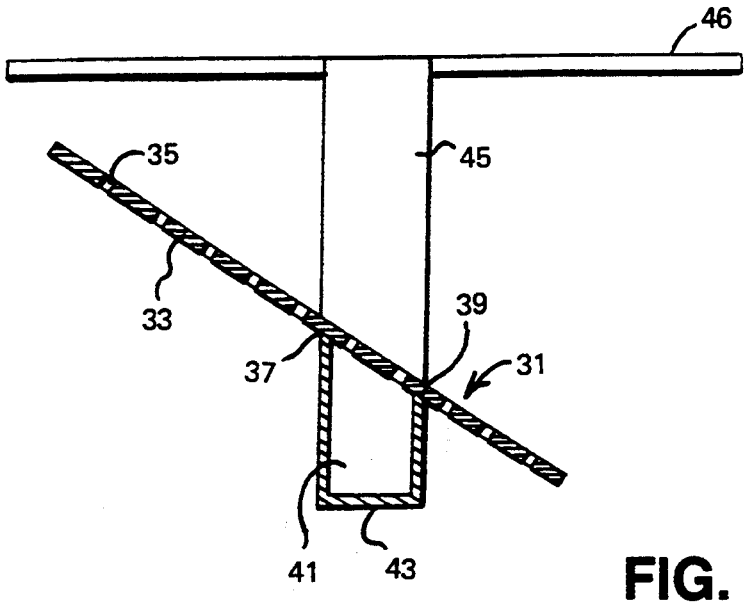
FIG. 7 is a cross-section of the regulator illustrated in FIG. 6, taken on the section IV—IV.

Referring now to FIGS. 6 and 7, an alternative embodiment of the regulator is illustrated. The regulator 31 comprises a perforated metallic plate 33, which has a plurality of holes 35 and which is supported on the edges 37, 39 of a reservoir 41. The plate is to be supported at an angle and this is accomplished by arranging for the edges 37, 39 to be of different heights with respect to the base 43 of the reservoir 41. The reservoir has an open top which is covered by part of the perforated plate 33. Mounting straps 45 extend from the reservoir 41 and in practice form part of the reservoir. The straps are secured at their ends remote from the reservoir 41 to a continuous strip of metal 46 which can be clamped between manifold and carburetor flanges in the same manner as described with reference to the embodiment of FIGS. 1 to 5. The sides 49 of the reservoir taper inwardly to avoid the outer wall of the manifold. Because a plate is used in place of a gauze no support for the peripheral edges is required, the strength of the plate providing its own support.

All embodiments of the invention influence the passage of fuel air mixture to the engine in a similar way. Firstly, the perforated plate or gauze acts to improve atomization and hence the mixing of the fuel air as it passes through from the carburetor to the engine. Secondly, excess unvaporized fuel present in the inflowing air stream contact the gauze and collects in the petrol trap reservoir, thus excess fuel is prevented from entering the engine. Thirdly, when the engine operating conditions demand an increased quantity of petrol, the fuel continued in the petrol trap reservoir vaporizes, under the influence of suction in the manifold and passes out of the reservoir through the gauze and down into the engine, thus the device operates to smooth out irregularities in the fuel air mixture.

The induction regulator may be formed integrally with the carburetor or induction manifold.

What is claimed is:

1. An induction regulator, for an internal combustion engine having a carburetor and a manifold downstream thereof, the regulator comprising: at least one perforated element for allowing passage of fuel and air mixture therethrough; at least one open top reservoir for retaining excess unvaporized fuel; a closed loop supporting strip; and a plurality of strips coupling the perforated element to the closed loop; wherein the closed loop supporting strip is mountable between opposed flanges of the engine manifold.

2. A regulator according to claim 1 comprising two perforated elements, each element having an open top reservoir and a common continuous strip which is coupled to both elements.

3. An induction regulator according to claim 1, wherein the perforated element is angled with respect to the plurality strips extending therefrom.

4. An induction regulator according to claim 1, wherein the perforated element comprises a metal gauze bounded by a frame having a shape which corresponds with that of an inlet in said engine manifold and into which the regulator is to be fitted.

5. An induction regulator according to claim 4, wherein the gauze is planar and disposed at an angle to a wall in the engine manifold, wherein the angle is in the range of about 13 degrees to about 25 degrees.

6. An induction regulator according to claim 5, wherein the angle is about 18 degrees.

7. An induction regulator according to claim 4, wherein the reservoir comprises a rectangular tank which is secured to the metal gauze frame.

8. An induction regulator according to claim 4, wherein the reservoir comprises a rectangular tank which forms part of the metal gauze frame.

9. An induction regulator according to claim 7, wherein the tank extends across the width of the gauze.

10. An induction regulator according to claim 1, wherein the perforated element is a perforated metal plate.

* * * * *